United States Patent [19]

Laurent

[11] 4,149,690

[45] Apr. 17, 1979

[54] POSITIVE-RESPONSE TRANSIT DETECTOR FOR A GIVEN TRANSIT ZONE

[75] Inventor: Daniel M. Laurent, Paris, France

[73] Assignee: Jeumont-Schneider, Puteaux, France

[21] Appl. No.: 729,723

[22] Filed: Oct. 5, 1976

[30] Foreign Application Priority Data

Oct. 17, 1975 [FR] France ..... 75 31763

[51] Int. Cl.[2] ..... B61L 1/10; B61L 29/00

[52] U.S. Cl. ..... 246/34 CT

[58] Field of Search ..... 246/34 R, 34 CT, 77, 246/122 R, 167 R, 182 R, 247, 249

[56] References Cited

U.S. PATENT DOCUMENTS 3,529,150 9/1970 Coupin ..... 246/34 CT

FOREIGN PATENT DOCUMENTS 1530430 5/1970 Fed. Rep. of Germany ..... 246/34 R
2191512 2/1974 France ..... 246/34 R
2206722 6/1974 France ..... 246/34 R

*Primary Examiner*—Stephen G. Kunin

[57] ABSTRACT

An electronic track zone detecting device for providing a signal representing location and direction of travel of a railway apparatus within the zone. The detecting device comprises two frames, of insulated open conductive loop structures, defining the extremities of the zone.

5 Claims, 1 Drawing Figure

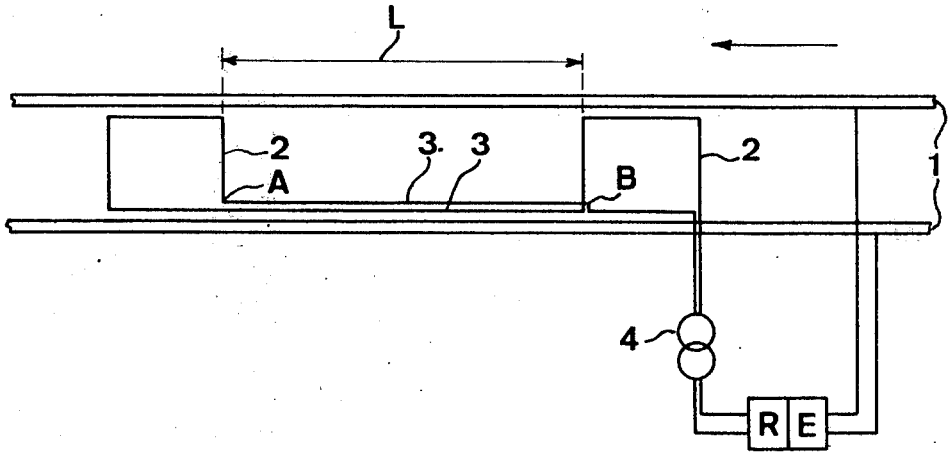
L
2
A
3
3
B
2
1
4
R
E

POSITIVE-RESPONSE TRANSIT DETECTOR FOR A GIVEN TRANSIT ZONE

This invention relates to a positive-response transit detector for a given transit zone, such as a section of railway.

Railway signaling often calls for the use of systems which can detect the passage of a vehicle or train in a given zone of the track and, as a safety feature, deliver in response to such passage a positive response—i.e., information embodied as the appearance of a signal.

There are positive detectors which can detect the passage of a vehicle past a given point, such as track treadles or the detector disclosed by the Applicant's French patent specification No. 2,191,512 of June 27, 1972. Unfortunately, such systems have the disadvantage of being one-point devices—i.e., they cannot detect the passage or transit of a vehicle in a given zone up to e.g. 30 meters in length.

The detector according to this invention, however, meets this requirement. In regard to its operating principle, it can be considered to be a short-range track circuit without insulating joints; Its detecting system is specially devised so that the detector according to the invention can operate as a positive-response treadle outputting a signal of limited duration either when a vehicle or train clears a section or while it is in the section, in accordance with the direction of the movement of the train or vehicle relative to the layout of the detector. The duration of the positive response can be adjusted as required without any need to use a delay circuit such as is necessary in other similar systems. The detector according to the invention is mainly distinguished in that it comprises:

- a transmitter supplying to the track voltage pulses the frequency of which is high enough to ensure a limited propagation distance;
- A sensor or detector comprising two identical frames which are disposed between the rails of the track near the transmitter and at a separation distance from each other corresponding to the length of the transit zone, each frame being embodied by an insulated open conductive loop, the two frames being connected in series and in opposition by two adjacent insulated conductors, and a receiver which receives by way of a matching transformer the pulses detected by the two frames and which is adapted to check the amplitude and frequency of the voltages induced in the transformer secondary and to output a d.c. signal of given amplitude.

For a clearer description of the design and operation of the detector according to the invention, a fuller description will now be given, reference being made by way of example to an embodiment for which the circuit arrangement is shown in the single FIGURE forming the accompanying drawing.

Referring to the drawing, rails 1 of a railway track are energized by a transmitter E outputting voltage pulses of a frequency of the order of a kHz. A detector is provided in the form of two identical frames 2 which are disposed in the track near transmitter E and spaced apart from one another by a distance L equal to the length of the transit zone. Each frame is embodied by a single open conductive loop made of insulated cable. The two loops are connected in series with and in opposition to one another by means of two adjacent insulated conductors 3. The two loops and their connecting wiring 3 can, if required, be integral with the same cable which in the accompanying drawing is shown as being between the two rails. Connected to the ends of the system formed by the two frames is a matching transformer 4 which energizes a receiver R adapted in known manner to check the amplitude and frequency of the voltage pulses it receives and to output, in response to the passage of a vehicle or train, a d.c. signal of given amplitude. The transmitter E and the receiver R can be devised in the manner disclosed by the Applicant's French patent specification No. 1,525,162 of March 17, 1967.

When no vehicle is passing over either of the frames 2, the same outputs no signal since the voltages induced in the two-frame system are always equal and opposite to one another so that the resulting output is zero. Depending on the direction in which the vehicle is moving, it approaches the detector either in the region where the transmitter E is connected to the rails or in the region where the left-hand frame 2 is disposed. When the vehicle approaches the system via the left-hand frame i.e., when it is travelling in the opposite direction to the direction indicated by the single arrow—the leading axle, upon entering the zone of the left-hand frame 2, reduces the voltage induced by the transmitter in the corresponding loop. The voltage induced in the complete two-loop system increases as the axle moves over the left-hand loop and peaks when the axle reaches the position A of the left-hand loop. The voltage remains at its peak value while the axle travels the distance L as far as position B of the right-hand loop, the voltage then decreases as the axle moves past the second loop and drops to zero when the axle leaves the zone associated with the two frames. The system thus operates as a positive-response indicating detector or treadle. When the vehicle approaches the detector from the transmitter end—i.e., in the case of a vehicle travelling in the direction indicated by the single arrow—if the distance between the place where the transmitter is connected to the track and the right-hand frame is such that, bearing in mind the maximum between-axles distance, one axle is always present between, on the one hand, the place where the transmitter is connected to the track and, on the other hand, the latter frame while the vehicle is passing by, only the passage of the final axle is detected. The voltage induced in the two-frame system increases as the trailing axle moves into the zone associated with the first or approach loop until the position B, then remains constant until the position A, then gradually decreases to drop to zero when the trailing axle has passed beyond the left-hand frame. The system then operates as a positive-response indicating release treadle.

The transmitter is therefore connected to the track either upstream or downstream of the detector and at an appropriate distance therefrom in the light of the direction of vehicle movement and the function which the detector is required to perform.

Since the time for which the detected information lasts depends upon the time for which the detector zone is occupied, the time can be varied by varying the distance L. For high-speed traffic the receiver can have associated with it a delay facility adapted to store the signal from the receiver so that the information lasts for an appropriate time.

The passage detector according to the invention can be used with advantage to solve many railway signalling problems, including level crossing indication releases.

I claim:

1. A positive-response transit detector for a given transit zone of a track and operating on the basis of a short track circuit without insulating joints, comprising:

a transmitter supplying to the two rails of the track voltage pulses in the kHz frequency range;

a detector comprising two identical frames which are disposed between the rails of the track near the transmitter and at a separation distance from each other corresponding to the length of the transit zone in the order of tens of meters on the track, each frame being formed by an insulated open conductive loop, the two frames being connected in series and in opposition by two adjacent insulated conductors;

a matching transformer connected to the frames; and a receiver connected to the matching transformer for receiving the pulses detected by the two frames and being adapted to check the amplitude and frequency of the voltage induced in a secondary winding of the transformer and to output a d.c. signal of given amplitude.

2. A detector according to claim 1 wherein a delay means is associated with the receiver for providing a signal of sufficient duration to detect high-speed vehicles.

3. A detector according to claim 1 wherein the voltage received by the receiver changes as the axle passes over the frames and remains constant between the frames.

4. Apparatus for detecting presence and transit of a railway apparatus in a zone of a railway track comprising:

(a) transmitting means communicating high frequency voltage pulses in the kHz frequency range to said track, (b) sensing means for detecting said pulses and providing an output signal representative thereof comprising:

(1) first frame comprising an insulated open conductive loop and having connecting means, (2) said connecting means comprising adjacent insulated conductors, (3) second frame substantially identical with said first frame, (4) said first and second frames connected to each other in series opposition by said connecting means, (5) said first and second frames disposed in said track in the vicinity of said transmitting means, (6) said first and second frames displaced by a distance defining said zone in the order of tens of meters on the track, (c) receiving means connected to said sensing means for:

(1) receiving pulses detected by said sensing means, (2) checking amplitude and frequency characteristics of said pulses, and (3) providing an output signal representative of said pulses, (d) matching transformer means for connecting said receiving means to said sensing means, whereby the amplitude of said pulses received by said receiving means varies as a function of location and direction of motion of said railway appratus within said zone.

5. A method of detecting the presence and direction of movement of a vehicle on a track at a location thereon, comprising:

(a) supplying voltage pulses in the kHz frequency range to a pair of track rails, the track rails being insulated from each other, (b) placing a pair of substantially identical frames between the track rails a distance from each other substantially equal to a transit zone in the order of tens of meters on the track, (c) connecting the frames in series and in opposition by a pair of insulated conductors, (d) connecting said frames to a matching transformer, (e) connecting a receiver to the matching transformer, wherein when a vehicle moves in one direction along the track, the voltage induced increases as an axle of the vehicle moves over the first frame, the voltage reaching a peak as the axle passes out of the first frame and remaining at a peak as the axle passes over the insulated conductors, and decreasing as the axle passes over the second frame, dropping to zero as the axle leaves the zone of the second frame.

* * * * *